US006619795B1

(12) United States Patent
Hiramatsu

(10) Patent No.: US 6,619,795 B1
(45) **Date of Patent: *Sep. 16, 2003**

(54) INK JET RECORDING APPARATUS

(75) Inventor: Soichi Hiramatsu, Hachioji (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/927,260

(22) Filed: Sep. 11, 1997

Related U.S. Application Data

(63) Continuation of application No. 08/338,134, filed on Nov. 9, 1994, now abandoned.

(30) Foreign Application Priority Data

Nov. 10, 1993 (JP) ..... 5-280958

(51) Int. Cl.[7] ..... B41J 2/01
(52) U.S. Cl. ..... 347/104
(58) Field of Search ..... 347/104; 346/134; 400/625, 636; 271/272, 274, 314, 188

(56) References Cited

U.S. PATENT DOCUMENTS

| | | | | | |
|---|---|---|---|---|---|
| 4,463,361 | A | * | 7/1984 | Koumura | 347/104 X |
| 4,721,968 | A | * | 1/1988 | Arai | 347/104 X |
| 4,728,963 | A | * | 3/1988 | Rasmussen et al. | 346/25 |
| 5,170,184 | A | * | 12/1992 | Hanabusa et al. | 346/134 |
| 5,177,547 | A | * | 1/1993 | Kanemitsu et al. | 347/104 |
| 5,226,743 | A | * | 7/1993 | Jackson et al. | 400/625 |
| 5,238,235 | A | * | 8/1993 | Nitta et al. | 271/9 |
| 5,274,399 | A | * | 12/1993 | Uchida et al. | 347/104 |
| 5,291,224 | A | | 3/1994 | Asano et al. | 347/104 |
| 5,321,467 | A | * | 6/1994 | Tanaka et al. | 347/104 |
| 5,359,435 | A | * | 10/1994 | Hayashi et al. | 347/104 |
| 5,363,129 | A | * | 11/1994 | Kline et al. | 347/104 |
| 5,368,403 | A | * | 11/1994 | Broder et al. | 400/352 |
| 5,373,312 | A | * | 12/1994 | Fujioka | 347/102 |
| 5,454,555 | A | * | 10/1995 | Kiyohara et al. | 271/9 |
| 5,502,464 | A | * | 3/1996 | Takahashi | 346/134 |
| 5,673,074 | A | * | 9/1997 | Miyauchi et al. | 347/104 |
| 5,793,399 | A | * | 8/1998 | Kawakami et al. | 347/104 |
| 5,847,719 | A | * | 12/1998 | Yamaguchi et al. | 346/134 |

FOREIGN PATENT DOCUMENTS

| | | | | |
|---|---|---|---|---|
| JP | 403221454 | * | 9/1991 | 347/104 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

An ink jet recording apparatus comprises a recording area where a recording sheet is conveyed substantially in a horizontal direction to a position opposite to a discharge port for discharging ink, and recording is performed by discharging ink from the discharge port downwardly substantially in a vertical direction to the recording sheet and a sheet-exhausting area where the recording sheet is conveyed from the recording area and exhausted. The sheet-exhausting area has a first sheet conveyor for introducing the recording sheet from the recording area to the sheet-exhausting area and a second sheet conveyor for holding the recording sheet introduced from the recording area to the sheet-exhausting area by the first sheet conveyor substantially in the horizontal direction or above the substantially horizontal direction and exhausting the recording sheet substantially in the horizontal direction or above the substantially horizontal direction.

21 Claims, 10 Drawing Sheets

INK JET RECORDING APPARATUS

This application is a continuation of application Ser. No. 08/338,134 filed Nov. 9, 1994, now abandoned.

BACKGROUND OF THE INVENTION

1. Field of the Invention

The present invention relates to an ink jet recording apparatus. More particularly, the invention relates to an ink jet recording apparatus having improved means for conveying sheets.

2. Related Background Art

As a recording apparatus, the so-called serial type recording apparatus has hitherto been used widely. As shown in FIG. 8, this apparatus is provided with a recording head 101 having discharge ports provided at a lower side thereof for discharging ink onto a recording sheet 102 downward substantially in the vertical direction and executes recording for one line after another, for example, by moving the head in the reverse and forward directions in FIG. 8 and then, conveys the recording sheet 102 by one line in the right-hand direction in FIG. 8 for recording the next line.

In such a recording apparatus, the recording sheet 102 is pressed by a pinch roller 104 to a feed roller 103. The recording sheet 102 closely in contact with the feed roller 103 is conveyed in the right-hand direction in FIG. 8 by the rotation of the feed roller 103 by driving means which is not shown.

Also, in the right-hand direction of the recording sheet 102, a sheet exhausting roller 105 and a spur 106 are arranged. The spur 106 is biased by a spur spring 107 to press the recording sheet 102 to the sheet exhausting roller 105. By the conveyance by the sheet exhausting roller 105, the recording sheet 102 is conveyed without slackening in a portion opposed to the recording head 101. On the trailing end thereof, the sheet exhausting,operation is performed so that the sheet falls into a sheet exhausting stacker 108.

However, according to the above-mentioned prior art, a problem is encountered that a leading end of the recording sheet 102 which is being currently printed rubs the printed surface of the recording sheet which has already been exhausted as shown in FIG. 9 so that the recording sheet 102 may be contaminated by ink in some cases.

Also, as shown in FIG. 10, there are problems that the trailing end of the recording sheet 102 leaping up when it is exhausted may be in contact with the discharge port surface of the recording head 101 so that the recording sheet 102 is contaminated. In addition, in some cases, defective discharges may occur because the discharge ports are damaged or dust particles are adhered to them. In order to solve these problems, it is conceivable that the recording head 101 is arranged to move out of the recording area when the recording sheet is exhausted. In this case, however, no recording operation is possible once the recording sheet has left the feed roller 103 and the pinch roller 104. Therefore, another problem is encountered that the recordable area should become narrower inevitably.

SUMMARY OF THE INVENTION

The present invention is designed to solve these problems. It is an object of the invention to provide an ink jet recording apparatus capable of preventing the leading end of the subsequently fed recording sheet from being caused to stain the printed recording sheet, and also, preventing the trailing end of the recording sheet from being in contact with the recording head.

In order to achieve the object, the present invention provides an ink jet recording apparatus comprising: a recording area where a recording sheet is conveyed substantially in a horizontal direction to a position opposite to a discharge port for discharging ink, and recording is performed by discharging ink from said discharge port downward substantially in a vertical direction to said recording sheet; and a sheet-exhausting area where said recording sheet is conveyed from said recording area and exhausted, said sheet-exhausting area having first sheet conveying means for introducing said recording sheet from said recording area to said sheet-exhausting area and second sheet conveying means for holding said recording sheet introduced from said recording area to said sheet-exhausting area by said first sheet conveying means substantially in the horizontal direction or above the substantially horizontal direction and exhausting said recording sheet substantially in the horizontal direction or above the substantially horizontal direction.

As stated above, the following advantages are obtained by arrangements of the embodiments showing such as an arrangement that second means for conveying a sheet for exhausting the recording sheet is provided at a position on an extended surface of the sheet conveyance route or deviated to a printing surface or upward in the vertical direction with respect to the extended surface.

(1) it is possible to delay the period of time in which the leading end of a current recording sheet is caused to contact the recorded surface of the sheet already exhausted, thus preventing ink stains from being generated; and (2) the rear end of the recording sheet can be prevented from leaping up when it is exhausted, thus enabling the recording operation to be executed even after the recording sheet is out of the feed roller and pinch roller and obtaining a wide recordable area.

Hereinafter, in conjunction with the accompanying drawings, the detailed description will be made of the embodiments according to the present invention.

DETAILED DESCRIPTION OF THE PREFERRED EMBODIMENTS

Hereinafter, in conjunction with the accompanying drawings, the detailed description will be made of the embodiments according to the present invention.

Figure 1:
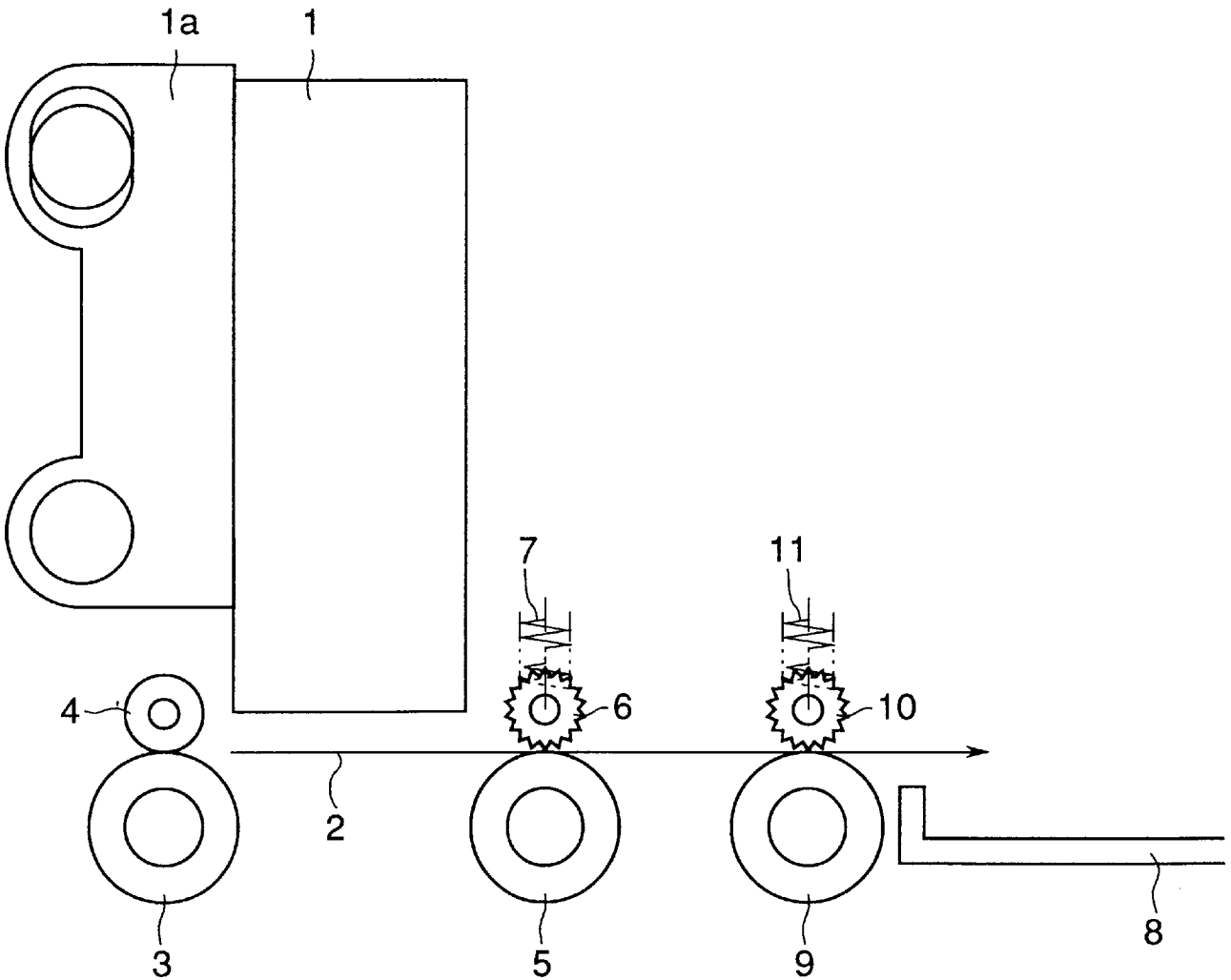
FIG. 1 is a schematic view showing the principal part of an ink jet recording apparatus according to a first embodiment of the present invention.

FIG. 1 is a schematic view showing the principal part of an ink jet recording apparatus according to a first embodiment of the present invention.

In the present embodiment, a pair of a second sheet exhausting roller 9 and a second spur 10 are additionally arranged on an exhaust sheet side of a sheet exhausting roller 5 and a spur 6. It is preferable to set a distance between a center of the sheet exhausting roller 5 and a center of the second sheet exhausting roller 9 at 1/20 to 1/2 of the length of the recording sheet having a size which is most frequently used. In the same way that the spur 6 is biased by the spur spring 7, the second spur 10 is biased by a spur spring 11 to press the sheet 2 to the second sheet exhausting roller 9.

Figure 9:
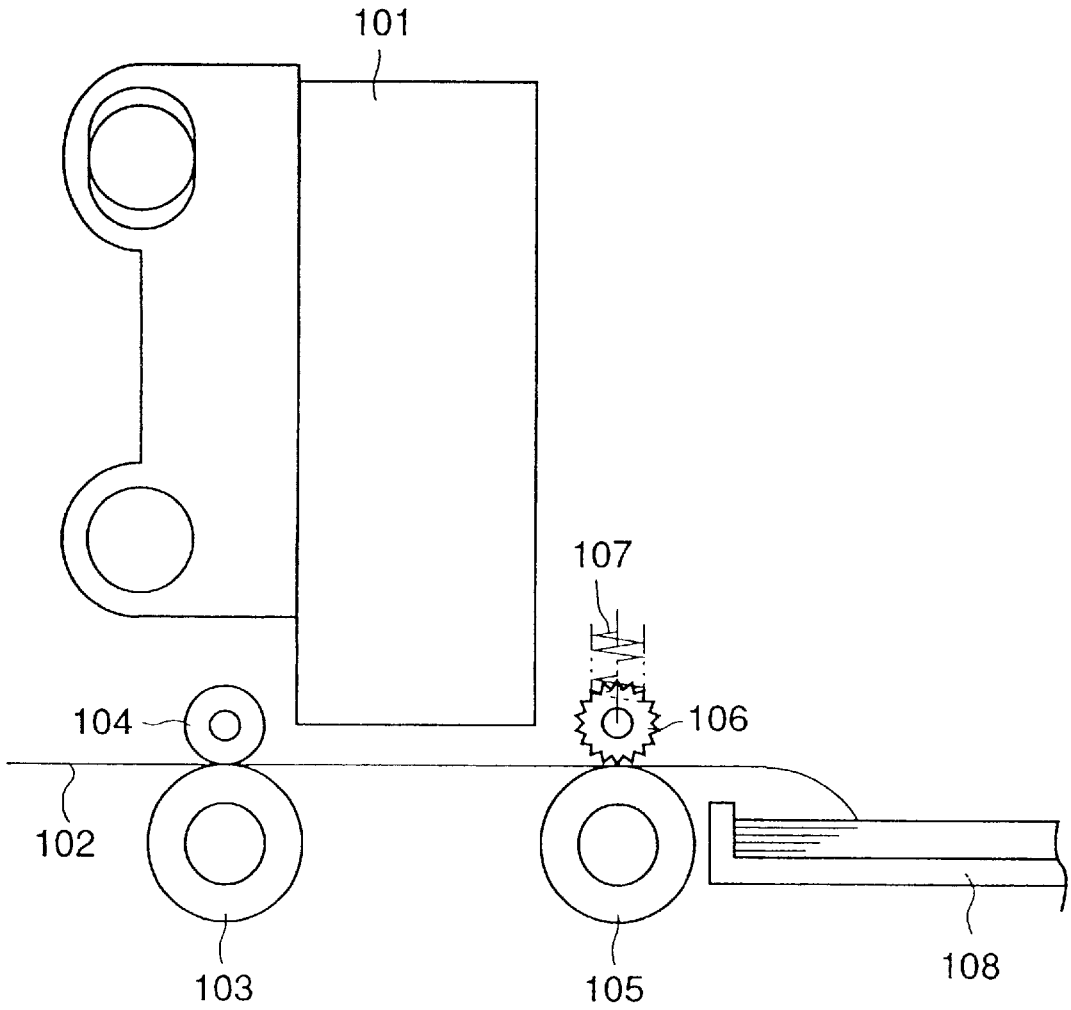
FIG. 9 PRIOR ART
FIG. 9 is a schematic view illustrating a problem encountered in the conventional example.

With the provision of the second exhaust sheet roller 9 and second spur 10, the sheet 2 on the exhaust sheet side is orientated planar substantially in the horizontal direction between the sheet exhausting roller 5 and the sheet exhausting roller 9. Therefore, together with the firmness or rigidity of the recording sheet, it is possible to move a contact point as already shown in connection with FIG. 9 further away for the leading end of the current recording sheet to be in contact with the recorded sheet, thus eliminating the possibility that the current printing sheet is caused to rub the printed portion of the recorded sheet before it is dried.

Figure 10:
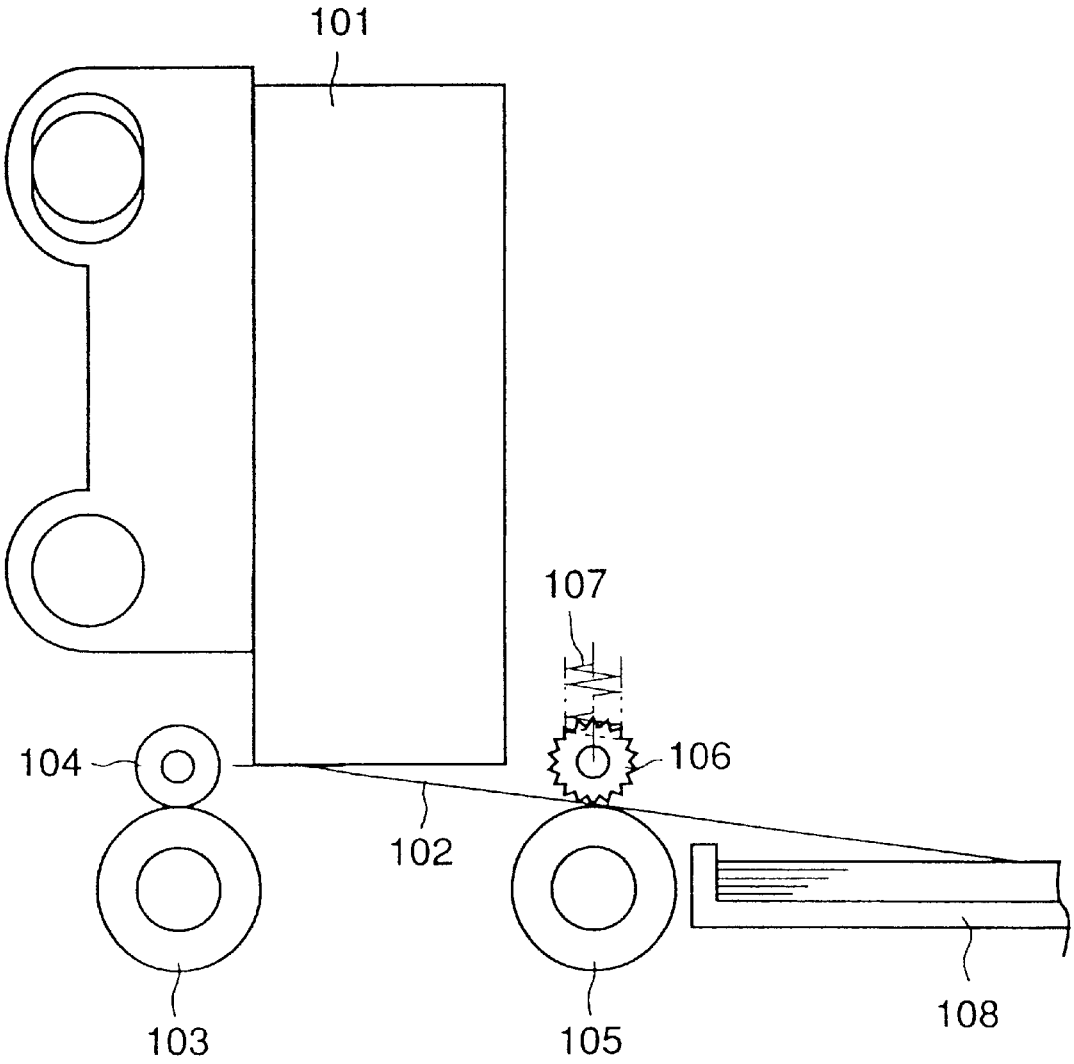
FIG. 10 PRIOR ART
FIG. 10 is a schematic view illustrating problems encountered in the conventional example.

Also, with the planar orientation of the sheet 2 substantially in the horizontal direction as described above, the contact of the rear end of the recorded sheet with the recording head 1 as in FIG. 10 showing prior art can be eliminated. That is, the rear end of the sheet 2 is conveyed with a clearance more than a predetermined value with respect to the recording head 1 since the sheet 2 is oriented planar substantially in the horizontal direction even after it has passed the conveying roller 3 and the pinch roller 4 as shown in FIG. 1. Here, the recording head 1 is mounted on a carriage 1*a*, and discharges ink downward substantially in the vertical direction by utilizing energy generated by means of an electrothermal transducer or the like for generating energy.

Figure 2:
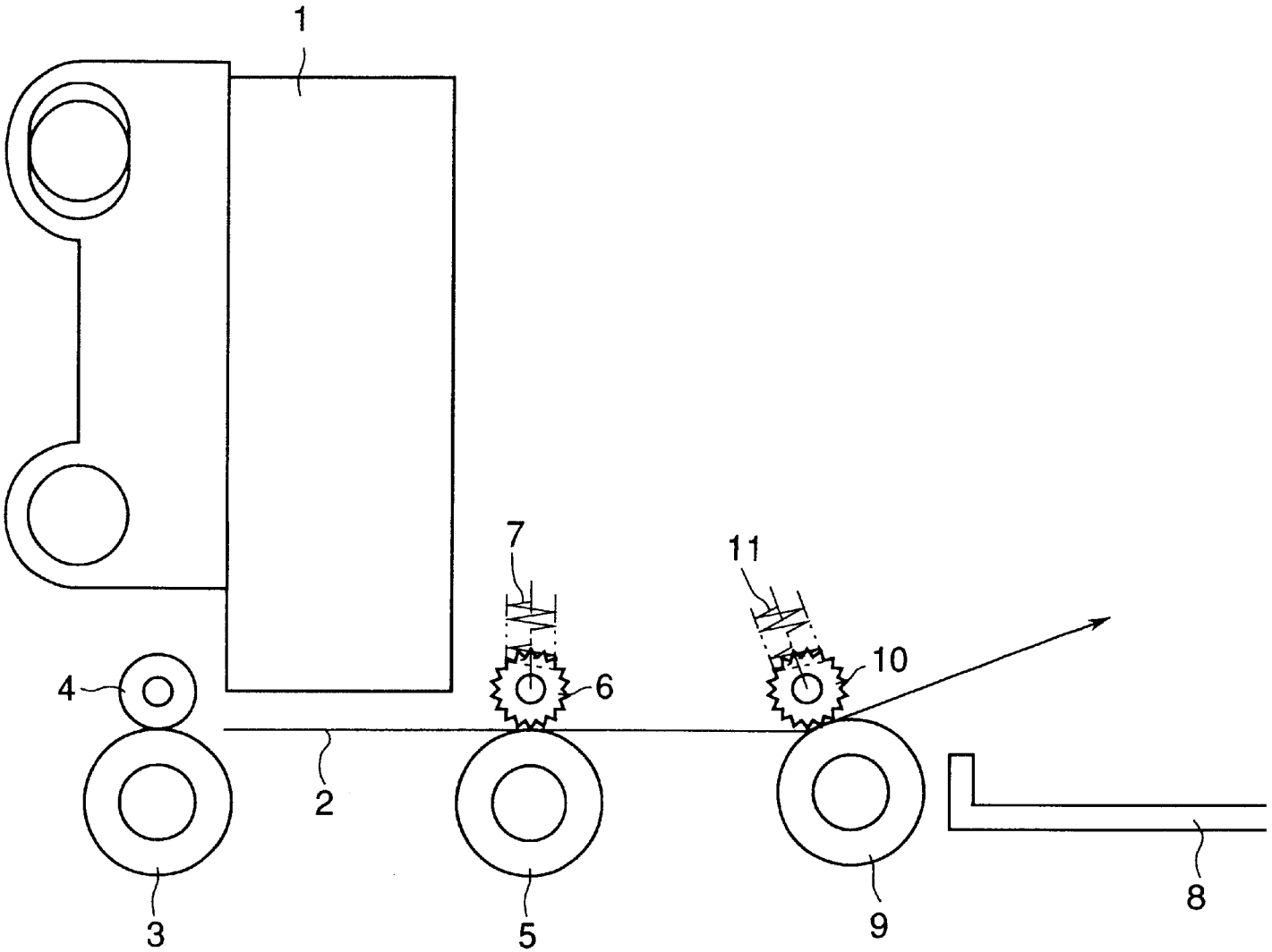
FIG. 2 is a schematic view showing the principal part of an ink jet recording apparatus according to a second embodiment of the present invention.

FIG. 2 is a schematic view showing the principal part of an ink jet recording apparatus according to a second embodiment of the present invention. As compared with the first embodiment, the position of the second sheet exhausting roller 9 is different. This roller is positioned on the printing surface side, that is, on the upper side substantially in the vertical direction, of an extended plane of the sheet path surface formed by the feed roller 3 and the sheet exhausting roller 5. As a result, the sheet path surface in the vicinity of the sheet exhausting portion presents a circular or a curved configuration having the printed surface side as its center. Hence, the leading end of the sheet 2 is orientated upward with respect to the stacker 8 to significantly reduce rubbing the surface of the printed sheet or it only contacts the surface thereof after the period of a considerable time. Therefore, the rubbing against the printed portion is substantially completely removed.

Also, with this combination of the circular or curved configuration of the sheet path surface for the rear end of the sheet 2 and the planar orientation of the sheet substantially in the horizontal direction, and together with the gravitational function exerted on the recording sheet, the recording sheet 2 does not approach the head 1 even when it is apart from the feed roller 3 and pinch roller 4, rather it is orientated in the direction that the sheet 2 is further away from the head 1. As a result, there is essentially no possibility at all that the recording sheet 2 is in contact with the recording head.

Figure 3:
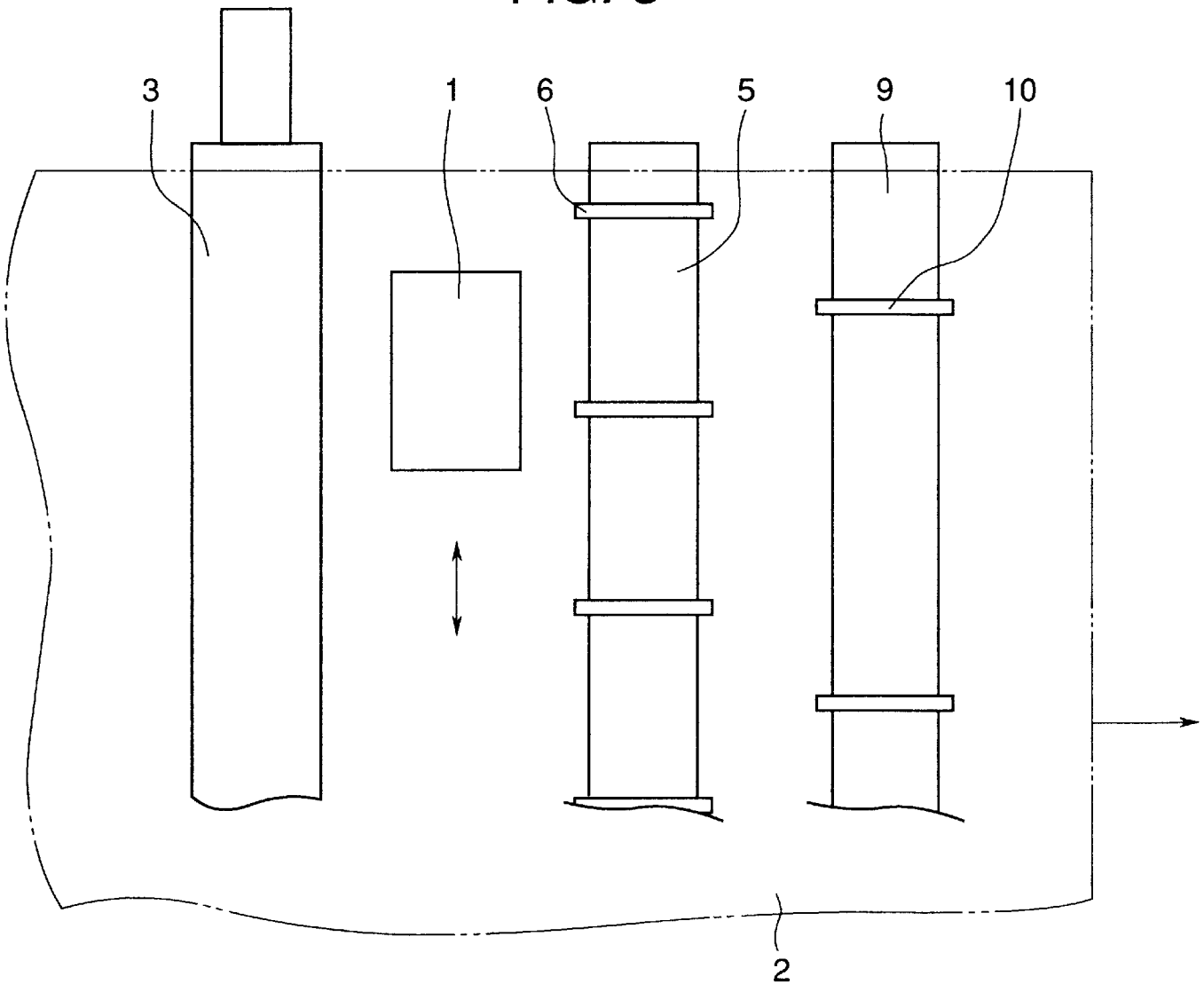
FIG. 3 is a schematic view showing the ink jet recording apparatus according to the first and second embodiments observed from an upper side of the printing surface.

FIG. 3 is a schematic view showing the arrangement of the sheet exhausting roller 5 and the second exhausting roller 9 according to the first and second embodiments observed from the printing surface side. According to the present embodiment, an arrangement pitch of the spur 6 opposed to the sheet exhausting roller 5 in the sheet exhausting section is small, while the arrangement pitch of the second spur 10 opposed to the second sheet exhausting roller 9 is large. This is because the major aim of the second spur 10 is to orientate the sheet while the function of feeding and the like is mainly executed by the sheet exhausting roller 5.

Here, it is preferable to arrange the spur 6 and second spur 10 to be displaced or offset from each other so that these spurs are not in contact with the recording sheet at the same location when it is fed as shown in FIG. 3.

Figure 4:
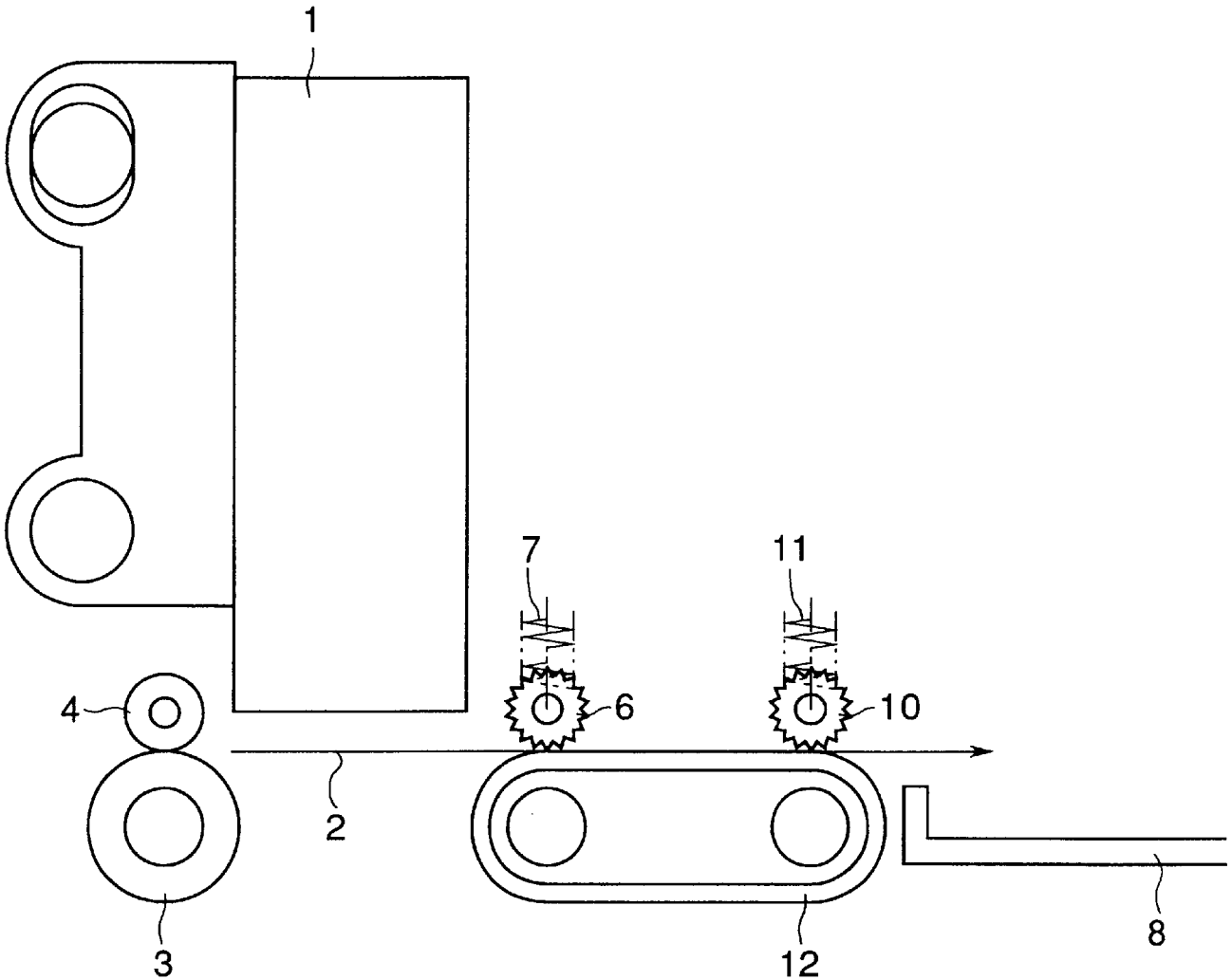
FIG. 4 is a schematic view showing the principal part of an ink jet recording apparatus according to a third embodiment of the present invention.

FIG. 4 is a schematic view showing the principal part of an ink jet recording apparatus according to a third embodiment of the present invention. As compared with the first embodiment, the present embodiment uses a sheet exhausting belt 12 in place of the sheet exhausting roller, thus implementing the enhancement of the transportability of the recording sheet and the further enhancement of its stability. The behavior of the leading and trailing or rear ends of the sheet 2 are almost the same as that of the first embodiment.

Further in the present embodiment, it is also possible to curve the sheet path as in the second embodiment, thus more reliably preventing the rubbing against the sheet by the leading end of the current recording sheet and the rubbing against the head by the rear end thereof, respectively.

Figure 5:
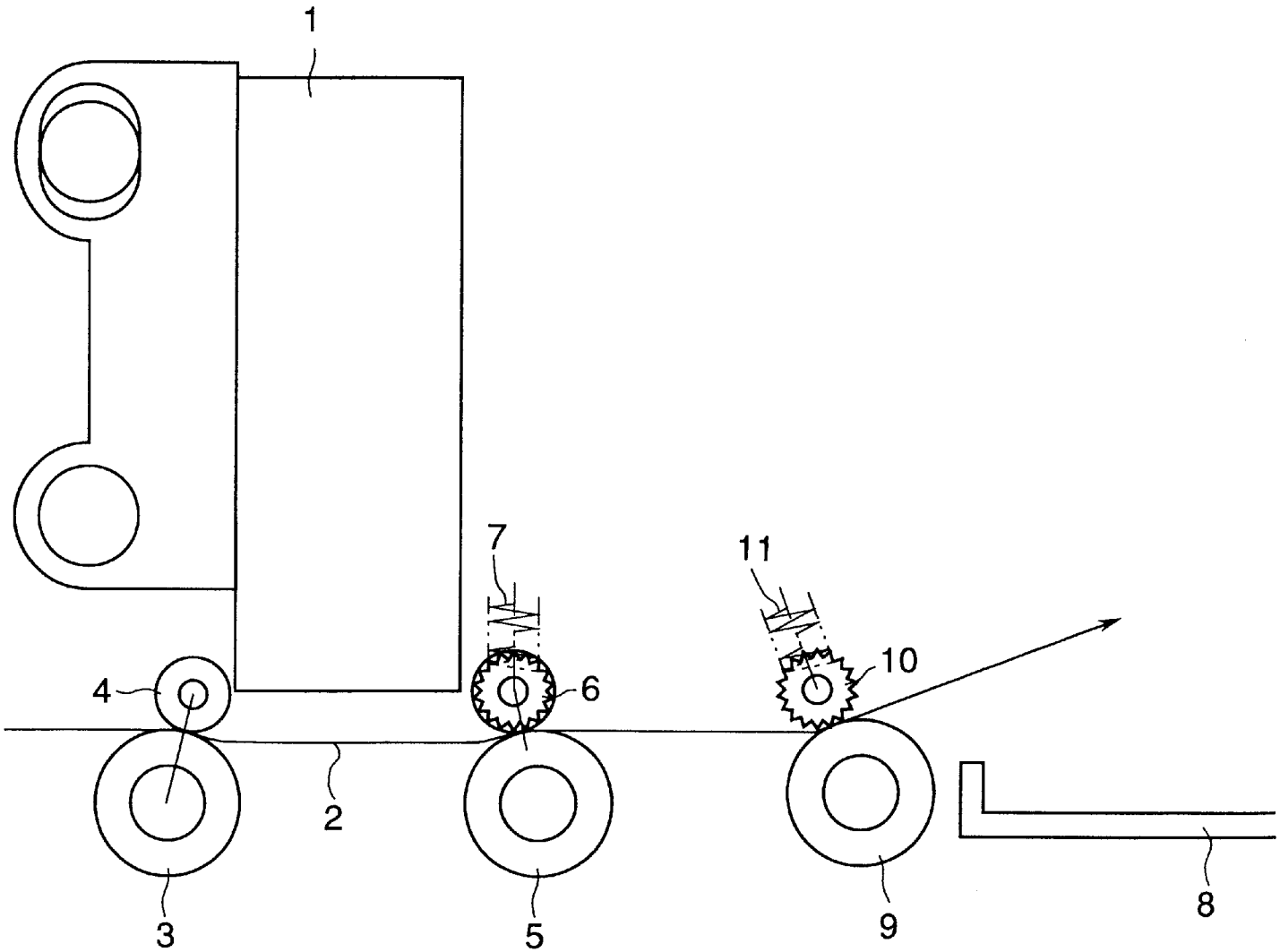
FIG. 5 is a schematic view showing the principal part of an ink jet recording apparatus according to a fourth embodiment of the present invention.

FIG. 5 is a schematic view showing the principal part of an ink Jet recording apparatus according to a fourth embodiment of the present invention. As compared with the second embodiment, the central position of the pinch roller 4 with respect to the feed roller 3 and that of the spur 6 with respect to the sheet exhausting roller 5 are displaced toward the printing area side from the central positions of the feed roller 3 and sheet exhausting roller 5, respectively, hence orientating the sheet 2 in the printing area in the direction away from the head 1. In this way, it is possible to make the behavior of the recording sheet at its leading end and rear end more stabilized.

Figure 6:
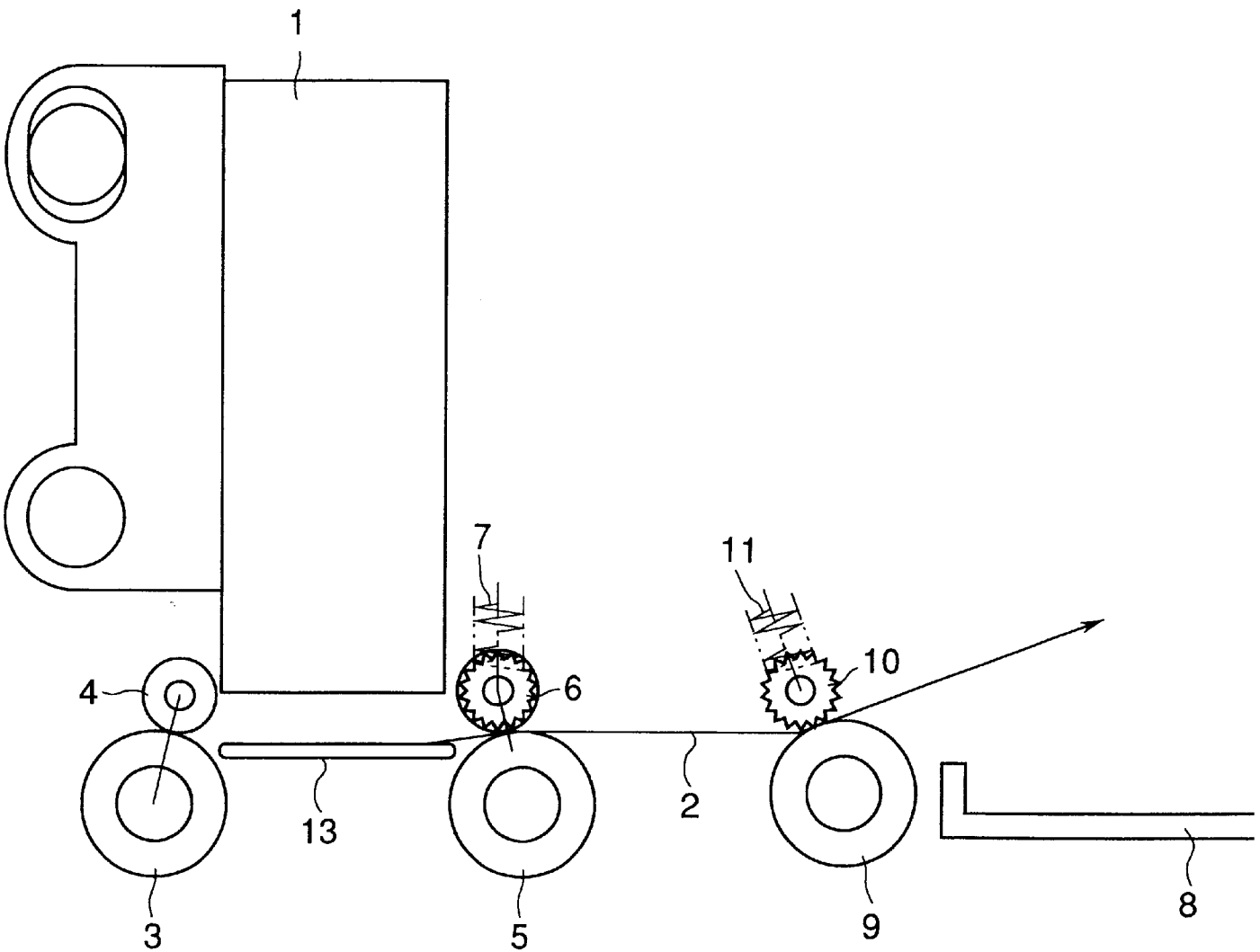
FIG. 6 is a schematic view showing the principal part of an ink jet recording apparatus according to a fifth embodiment of the present invention.

FIG. 6 is a schematic view showing the principal part of an ink jet recording apparatus according to a fifth embodiment of the present invention. In FIG. 6, a reference numeral 13 designates a platen which prevents the rear end of the sheet 2 from being placed extremely far from the head 1 when it is orientated. In this respect, both the pinch roller 4 and spur 6 should be displaced according to the fourth and fifth embodiments, but it is possible to obtain a reasonable effect even when only either one of them is displaced.

Figure 7:
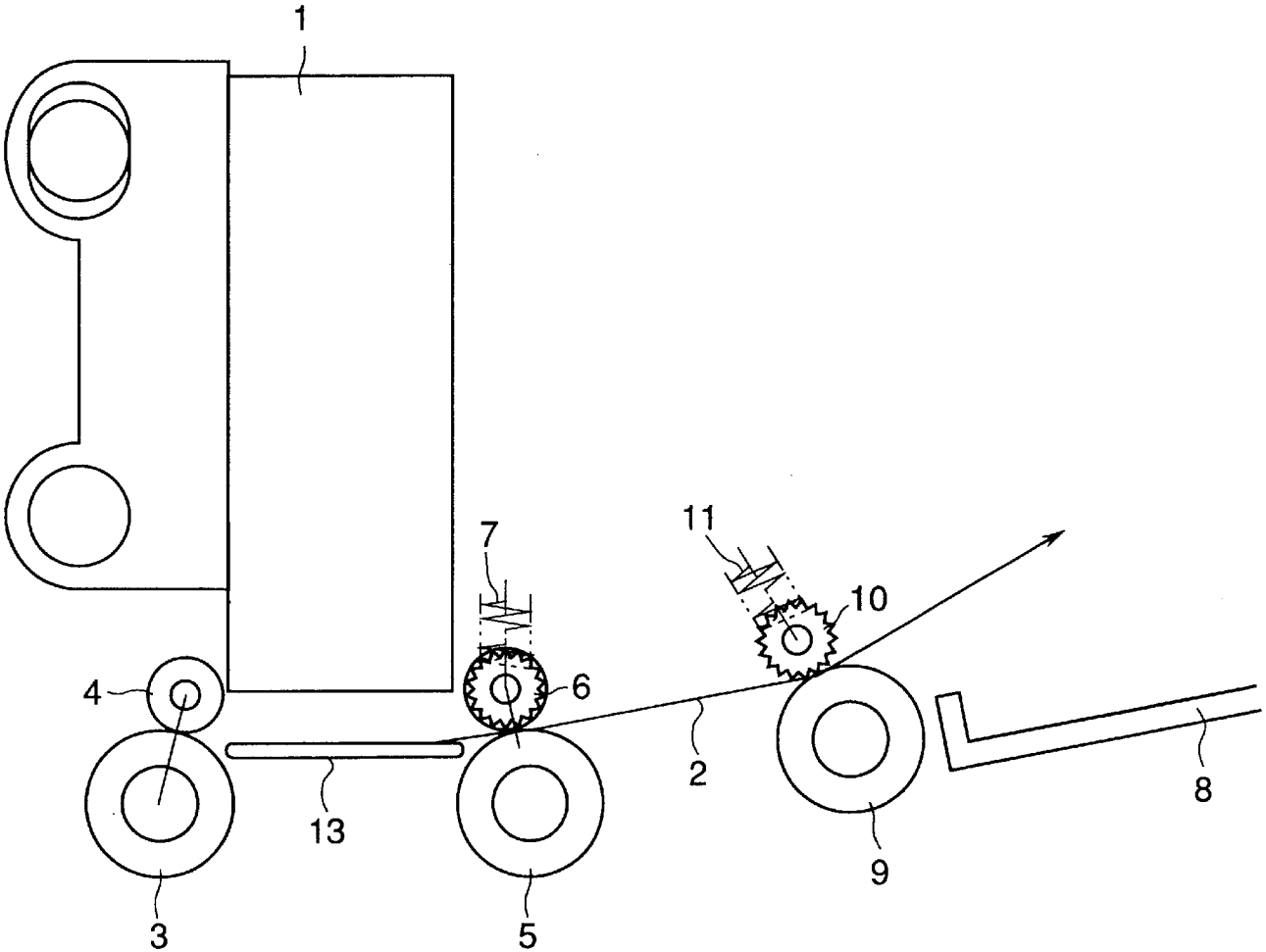
FIG. 7 is a schematic view showing the principal part of an ink jet recording apparatus according to a sixth embodiment of the present invention.
Figure 8:
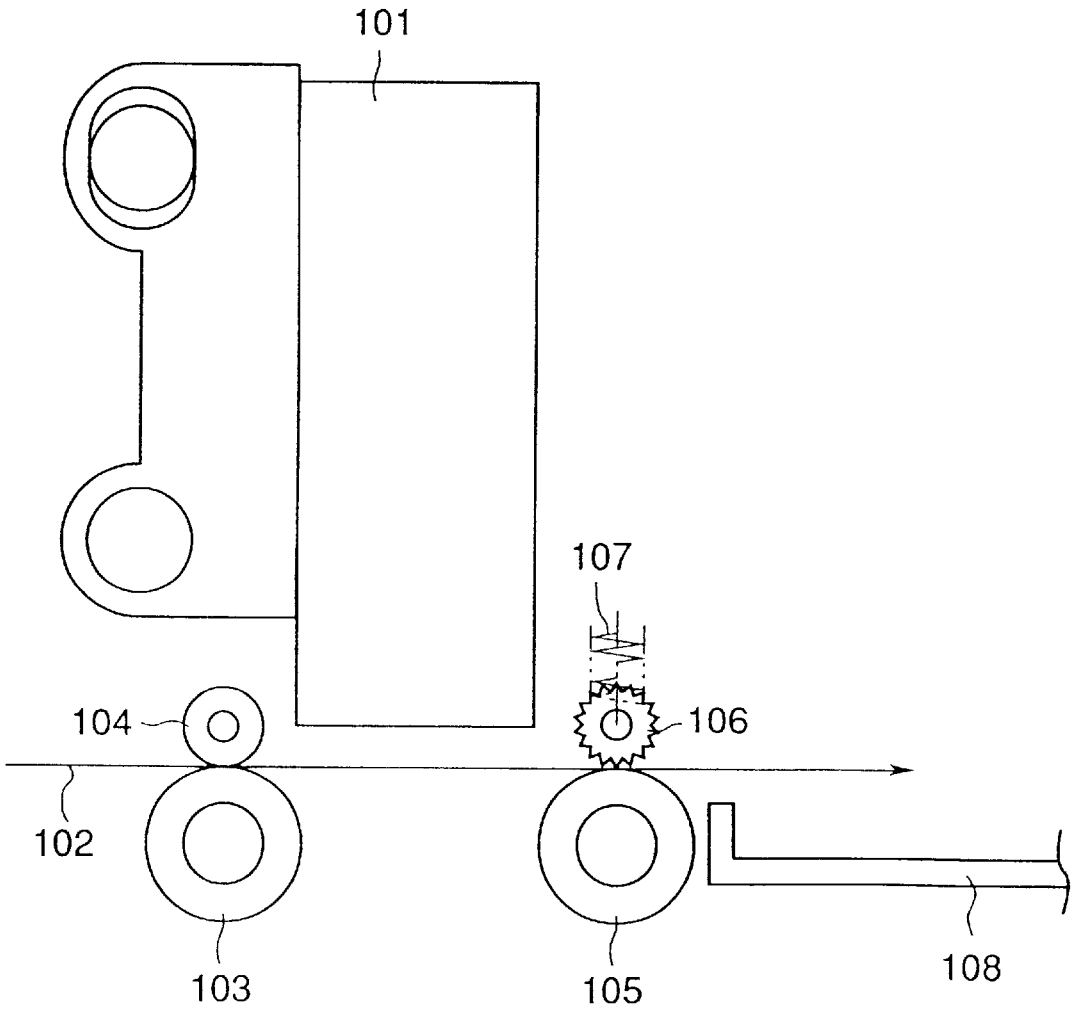
FIG. 8 PRIOR ART
FIG. 8 is a schematic view showing the principal part of an ink jet recording apparatus according to a conventional example.

FIG. 7 is a schematic view showing the principal part of an ink jet recording apparatus according to a sixth embodiment of the present invention. As compared with the fifth embodiment, the position of the second sheet exhausting roller 9 is displaced upward in order to increase the effect of the function for orienting the sheet 2 further away from the head 1 in the printing area.

What is claimed is:

1. An ink jet recording apparatus comprising:

a recording section at a recording area where a stackable recording sheet is conveyed substantially in a horizontal direction to a position opposite to a discharge port for discharging ink, and recording is performed by discharging ink from said discharge port downward substantially in a vertical direction to said recording sheet; and a sheet-exhausting section disposed immediately adjacent said recording section at a sheet-exhausting area where said recording sheet is conveyed from said recording area and exhausted, said sheet-exhausting section comprising first sheet conveying means for conveying said recording sheet introduced directly from said recording area substantially in the horizontal direction or in a first direction angled above the substantially horizontal direction, second sheet conveying means for holding said recording sheet sent directly from said first sheet conveying means and exhausting said recording sheet in a second direction angled above the substantially horizontal direction and a stacker for stacking said recording sheet exhausted directly from said second sheet conveying means, wherein said stacker is positioned so that a stacking surface of said stacker is parallel with a direction in which said recording sheet is conveyed from said first sheet conveying means to said second sheet conveying means.

2. An ink jet recording apparatus according to claim 1, further comprising a platen on a reverse side of a recording surface of said recording sheet at said recording area.

3. An ink jet recording apparatus according to claim 1, wherein said recording section comprises means for generating thermal energy utilized as energy for discharging ink from said discharge port.

4. An ink jet recording apparatus according to claim 3, wherein said means for generating thermal energy comprises an electrothermal converting member.

5. An ink jet recording apparatus according to claim 1, wherein a distance between a center of said first sheet conveying means and a center of said second sheet conveying means is 1/20 to 1/2 of a length of the recording sheet.

6. An ink jet recording apparatus according to claim 1, wherein said first sheet conveying means comprises a first roller, a first spring and a first spur biased to said first roller by said first spring, and said second sheet conveying means comprises a second roller, a second spring and a second spur biased to said second roller by said second spring.

7. An ink jet recording apparatus according to claim 6, wherein a line between centers of said first roller and said first spur and a line between said second roller and said second spur are not parallel.

8. An ink jet recording apparatus according to claim 1, wherein said first sheet conveying means comprises a belt and a first spur biased to said belt, and said second sheet conveying means comprises said belt and a second spur biased to said belt.

9. An ink jet recording apparatus comprising:

a recording section at a recording area where a stackable recording sheet is conveyed substantially in a horizontal direction to a position opposite to a discharge port for discharging ink, and recording is performed by discharging ink from said discharge port downward substantially in a vertical direction to said recording sheet; and a sheet-exhausting section disposed immediately adjacent said recording section at a sheet-exhausting area where said recording sheet is conveyed from said recording area and exhausted, said sheet-exhausting section comprising first sheet conveying means for conveying said recording sheet introduced directly from said recording area substantially in the horizontal direction, second sheet conveying means for holding said recording sheet sent directly from said first sheet conveying means and exhausting said recording sheet substantially in the horizontal direction and a stacker for stacking said recording sheet exhausted directly from said second sheet conveying means, wherein said stacker is positioned so that a stacking surface of said stacker is parallel with a direction in which said recording sheet is conveyed from said first sheet conveying means to said second sheet conveying means, wherein said first sheet conveying means and said second sheet conveying means each comprise more than one spur roller, and wherein spacing between adjacent spur rollers of said second sheet conveying means is greater than spacing between adjacent spur rollers of said first sheet conveying means.

10. An ink jet recording apparatus according to claim 9, further comprising a platen on a reverse side of a recording surface of said recording sheet at said recording area.

11. An ink jet recording apparatus according to claim 9, wherein said recording section comprises means for generating thermal energy utilized as energy for discharging ink from said discharge port.

12. An ink jet recording apparatus according to claim 11, wherein said means for generating thermal energy comprises an electrothermal converting member.

13. An ink jet recording apparatus according to claim 9, wherein a distance between a center of said first sheet conveying means and a center of said second sheet conveying means is 1/20 to 1/2 of a length of the recording sheet.

14. An ink jet recording apparatus according to claim 9, wherein said first sheet conveying means comprises a first roller, a first spring and first spurs biased to said first roller by said first spring, and said second sheet conveying means comprises a second roller, a second spring and second spurs biased to said second roller by said second spring.

15. An ink jet recording apparatus according to claim 14, wherein a plane between centers of said first roller and said first spurs and a plane between said second roller and said second spurs are parallel.

16. An ink jet recording apparatus according to claim 9, wherein said first sheet conveying means comprises a belt and first spurs biased to said belt, and said second sheet conveying means comprises said belt and second spurs biased to said belt.

17. An ink jet recording apparatus according to claim 16, wherein the upper surface of said belt is planar.

18. An ink jet recording apparatus according to claim 1, wherein said first sheet conveying means and said second sheet conveying means each comprise more than one spur roller, wherein spacing between adjacent spur rollers of said second sheet conveying means is greater than spacing between adjacent spur rollers of said first sheet conveying means.

19. An ink jet recording apparatus according to claim 1, wherein said first sheet conveying means and said second sheet conveying means each comprise more than one spur roller, wherein spur rollers of said first sheet conveying means are not aligned with spur rollers of said second sheet conveying means in a sheet conveying direction.

20. An ink jet recording apparatus according to claim 1, wherein the first direction is the same as the second direction.

21. An ink jet recording apparatus comprising:

a recording section at a recording area where a stackable recording sheet is conveyed substantially in a horizontal direction to a position opposite to a discharge port for discharging ink, and recording is performed by discharging ink from said discharge port downward substantially in a vertical direction to said recording sheet; and a sheet-exhausting section disposed immediately adjacent said recording section at a sheet-exhausting area where said recording sheet is conveyed from said recording area and exhausted, said sheet-exhausting section comprising first sheet conveying means for conveying said recording sheet introduced directly from said recording area substantially in the horizontal direction, second sheet conveying means for holding said recording sheet sent directly from said first sheet conveying means and exhausting said recording sheet substantially in the horizontal direction and a stacker for stacking said recording sheet exhausted directly from said second sheet conveying means, wherein said stacker is positioned so that a stacking surface of said stacker is parallel with a direction in which said recording sheet is conveyed from said first sheet conveying means to said second sheet conveying means, wherein said first sheet conveying means and said second sheet conveying means each comprise more than one spur roller, and wherein spur rollers of said first sheet conveying means are not aligned with spurs of said second sheet conveying means in a sheet conveying direction.

* * * * *

UNITED STATES PATENT AND TRADEMARK OFFICE

CERTIFICATE OF CORRECTION

PATENT NO. : 6,619,795 B1
DATED : September 16, 2003
INVENTOR(S) : Hiramatsu

It is certified that error appears in the above-identified patent and that said Letters Patent is hereby corrected as shown below:

Column 1,
Line 37, “exhausting,operation” should read -- exhausting operation --.

Signed and Sealed this

Ninth Day of March, 2004

JON W. DUDAS
*Acting Director of the United States Patent and Trademark Office*